US011168700B2

(12) United States Patent
Darry

(10) Patent No.: US 11,168,700 B2
(45) Date of Patent: Nov. 9, 2021

(54) METHOD FOR CONTROLLING THE OUTLET PRESSURE OF A COMPRESSOR

(71) Applicant: Cryostar SAS, Hesingue Grand Est (FR)

(72) Inventor: Marina Darry, Mulhouse Grand Est (FR)

(73) Assignee: CRYOSTAR SAS, Hesingue (FR)

( * ) Notice: Subject to any disclaimer, the term of this patent is extended or adjusted under 35 U.S.C. 154(b) by 26 days.

(21) Appl. No.: 16/757,782

(22) PCT Filed: Oct. 11, 2018

(86) PCT No.: PCT/EP2018/077695

§ 371 (c)(1),
(2) Date: Apr. 21, 2020

(87) PCT Pub. No.: WO2019/086225

PCT Pub. Date: May 9, 2019

(65) Prior Publication Data

US 2021/0190084 A1 Jun. 24, 2021

(30) Foreign Application Priority Data

Oct. 31, 2017 (EP) ..... 17306506

(51) Int. Cl.
*F04D 27/00* (2006.01)
*F04D 27/02* (2006.01)
(Continued)

(52) U.S. Cl.
CPC ..... *F04D 27/0207* (2013.01); *F04D 17/12* (2013.01); *F04D 29/284* (2013.01)

(58) Field of Classification Search
CPC ..... F04D 17/12; F04D 17/122; F04D 27/003; F04D 27/0207; F04D 27/0253;
(Continued)

(56) References Cited

U.S. PATENT DOCUMENTS 4,288,198 A * 9/1981 Hibino ..... F04D 27/02 415/1
8,840,358 B2 * 9/2014 Huis In Het Veld ..... F04D 27/0207 415/1

(Continued)

FOREIGN PATENT DOCUMENTS

WO 2010/012559 A2 2/2010
WO 2010/040734 A1 4/2010

OTHER PUBLICATIONS

International Search Report of the International Searching Authority for PCT/EP2018/077695 dated Jan. 14, 2019.

*Primary Examiner* — Ninh H. Nguyen
(74) *Attorney, Agent, or Firm* — Millen White Zelano & Branigan, PC; Brion P. Heaney

(57) ABSTRACT

Method for controlling a compressor comprising a last stage (40) and a compressor load controller (90), a set point outlet pressure corresponding to the consumer needed pressure, being given in the load controller (90) comprising the steps of: a—measuring the temperature at the inlet of the last stage (40), b—measuring the ratio between the outlet and inlet pressure of the last stage (40), c—computing a coefficient (Ψ) based on the value of the inlet temperature (Tin) and on the pressure ratio (Pout/Pin), d—if the coefficient (Ψ) is in a predetermined range, changing the set point outlet pressure by a new greater set point outlet pressure until the coefficient (Ψ) computed with the new set point outlet pressure goes out of the predetermined range, and e—adapting the pressure of the fluid coming out of the compressor in a pressure regulator (100) to the consumer needed pressure.

12 Claims, 1 Drawing Sheet

Figure 1:
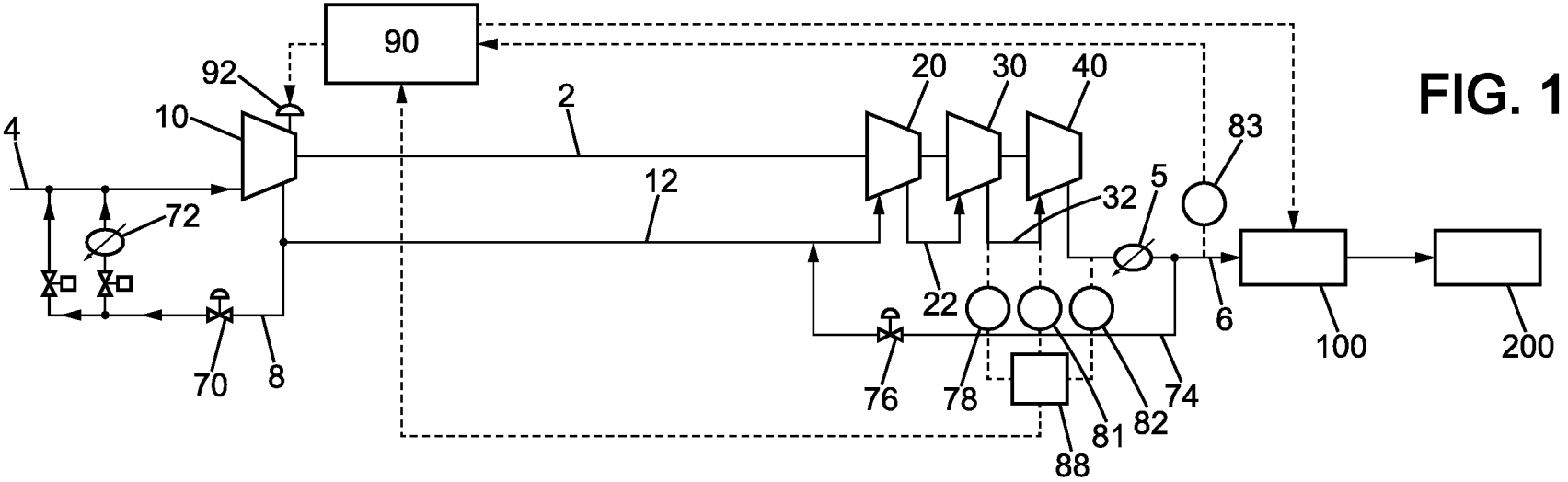

(51) Int. Cl.
*F04D 17/12* (2006.01)
*F04D 29/28* (2006.01)

(58) Field of Classification Search
CPC ..... F05D 2270/101; F05D 2270/3011; F05D 2270/3013; F05D 2270/303
See application file for complete search history.

(56) References Cited

U.S. PATENT DOCUMENTS

| | | | | |
|---|---|---|---|---|
| 8,939,704 | B2 * | 1/2015 | Winkes ..... | F04D 29/5826 415/1 |
| 10,184,482 | B2 * | 1/2019 | Arnou ..... | F04D 27/0284 |
| 2011/0130883 | A1 | 6/2011 | Van Dijk | |
| 2012/0121376 | A1 | 5/2012 | Huis In Het Veld | |
| 2016/0273711 | A1 | 9/2016 | Hwang | |

* cited by examiner 200
100
83
6
5
74
82
81
88
40
32
30
78
20
22
76
12
2
90
92
10
8
70
72
4

200
100
83
6
5'
74
82
81
88
60
52
50
78
40
42
86
32
2
5
30
74
20
22
76
12
90
92
10
8
70
72
4

METHOD FOR CONTROLLING THE OUTLET PRESSURE OF A COMPRESSOR

This invention relates to a method for controlling the outlet pressure of a compressor and a control system for implementing such a method. It concerns more particularly the control of a plural stage centrifugal compressor in order to avoid it entering into a stonewall area.

In particular, it relates to the supply of natural gas to an engine or other machine for doing work. This engine, or machine, (and the compressor) may be on board on a vehicle (ship, train, . . . ) or onshore. The gas at the inlet of the compressor comes for example from a storage of LNG (Liquefied Natural Gas). Therefore, it can be at low temperature (below −100° C.). It may be boil-off gas or vaporized liquid.

As well-known from a man having ordinary skill in matter of compressors, a compressor and also a plural stage compressor only works in given conditions which depend of the features of the compressor. The use of centrifugal compressors is limited on the one hand by stonewall conditions and on the other hand by surge conditions.

Stonewall occurs when the flow becomes too high relative to the head. For example, in a compressor with a constant speed, the head has to be greater than a given value.

Surge occurs when the flow of gas decreases in the compressor so that the compressor cannot maintain a sufficient discharge pressure. The pressure at the outlet of the compressor can then become lower than the pressure at the inlet. This can damage the compressor (impeller and/or shaft).

It is well known in the prior art to protect a compressor from surge condition by means of an "anti-surge" line which connect the outlet of the compressor with its inlets and fitted with a bypass valve.

U.S. Pat. No. 4,526,513 discloses a method and apparatus for control of pipeline compressors. This document concerns more particularly the surge conditions of compressors. However, it indicates that if stonewall is present, it is necessary to put additional compressor units on line. This solution cannot ever been applied and if it can, it is an expensive solution.

There are many kinds of engines running on natural gas (LNG). One kind of engines is known as XDF engines. A XDF engine requires a compressor with variable discharge pressure. This compressor is for example a plural stage centrifugal compressor. In case of a too low discharge set point, the compressor, or the last stage of the compressor, may enter in the stonewall area.

An object of the present invention is the provision of a control system for a compressor, namely a plural stage compressor, for avoiding stonewall conditions.

For meeting this object or others, a first aspect of the present invention proposes a method for controlling a compressor comprising at least a last stage and a compressor load controller, a first set point outlet pressure, corresponding to a consumer needed pressure, being given in the load controller.

According to this invention, this method comprises the steps of:

a—measuring the temperature at the inlet of the last stage, b—measuring the ratio between the outlet pressure and the inlet pressure of the last stage of the compressor, c—computing a coefficient based at least on the value of the inlet temperature and on the measured pressure ratio, d—if the computed coefficient is in a predetermined range, changing the first set point outlet pressure by a second set point outlet pressure greater than the first set point outlet pressure until the coefficient computed with the second set point outlet pressure goes out of the predetermined range, and e—adapting the pressure of the fluid coming out of the compressor in a pressure regulator to the first set point outlet pressure corresponding to the consumer needed pressure.

In an original way, the method is based on the computation of a coefficient depending from the temperature and from the pressures and also originally proposes to increase the pressure over the required pressure at the outlet of the last stage of the compressor.

In a first embodiment of this method, the coefficient calculated in step c may be a coefficient calculated by multiplying the inlet temperature of the compressor by a logarithm of the ratio of the outlet pressure by the inlet pressure.

A preferred embodiment of this method foresees that the coefficient calculated in step c is a head coefficient:

$$\Psi=2*\Delta h/U^2$$

where:

Δh is the isentropic enthalpy rise in the last stage,

U is the impeller blade tip speed, and in that $$\Delta h=R*T\text{in}*\text{In}(P\text{out}/P\text{in})/MW$$

where:

R is a constant,

Tin is the temperature of the gas at the inlet of the last stage,

Pout is the pressure at the outlet of the last stage,

Pin is the pressure at the inlet of the last stage, and

MW is the molecular weight of the gas going through the compressor.

In this embodiment, it is supposed that the gas is an ideal gas and that the transformation is isentropic and adiabatic. This approximation gives good results into industrial realities.

In the above defined method, step d can be the following: if the computed coefficient is less than a predetermined value, the second set point outlet pressure is so that the coefficient computed with this second set point outlet pressure equals the predetermined value.

In an above-described method, the compressor can for example be a plural stage compressor. In that case, at least one stage of the compressor advantageously comprises a variable diffusor valve and the compressor load controller can for example adjust the discharge pressure of the compressor by acting on at least one variable diffusor valve.

The invention concerns also a gas supplying system with a compressor comprising:

at least one compressor stage, so called last stage, a compressor load controller, a temperature sensor for measuring the temperature at the inlet of the last stage, a first pressure sensor for measuring the pressure at the inlet of the last stage, characterised in that the system further comprises:

a pressure regulator downstream from the last stage, and means for implementing a method as described here above.

This system can supply gas for a consumer which can be an engine or a gas combustion unit. In this gas supplying system, at least a compressor stage comprises for example a variable diffusor valve.

The compressor of this gas supplying system can be a plural stage centrifugal compressor. This plural stage compressor may be a four-stage or a six-stage compressor.

In a gas supplying system according to the invention, each stage may comprise an impeller, and all said impellers may be mechanically connected.

These and other features of the invention will be now described with reference to the appended figures, which relate to preferred but not-limiting embodiments of the invention.

Figure 2:
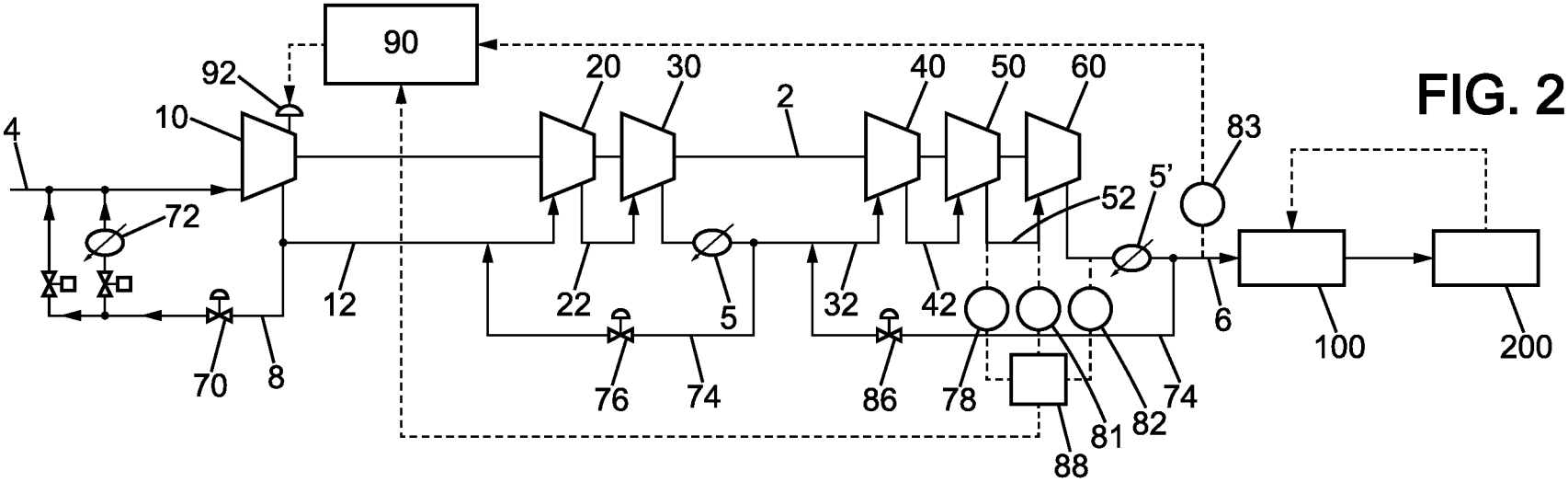

FIGS. 1 and 2 illustrate two examples of a possible implementation of the invention.

Same reference numbers which are indicated in different ones of these figures denote identical elements or elements with identical function.

FIG. 1 shows a plural stage compressor which is in this example a four-stage compressor. Each stage 10, 20, 30, 40 of the compressor which is schematically shown on FIG. 1 comprises a centrifugal impeller with a fixed speed. The stages are mechanically coupled by a shaft 2 and/or by a gearbox. The impellers can be similar but they can also be different, for example with different diameters.

A supply line 4 feeds gas to the compressor, more particularly to the inlet of the first stage 10 of the compressor. The stages of the compressor are counted along the flow of the gas through the compressor. The first stage 10 corresponds to the impeller placed upstream and the fourth or last stage corresponds to the impeller placed downstream. The gas can be for example boil-off gas from a storage tank on-board a boat or onshore.

After passing through the first stage 10, the gas is feed by a first inter-stage line 12 to the inlet of the second stage 20. After passing through the second stage 20, the gas is feed by a second inter-stage line 22 to the inlet of the third stage 30. After passing through the third stage 30, the gas is feed by a third inter-stage line 32 to the inlet of the fourth stage 40 (last stage).

After the fourth stage 40 the compressed gas may be cooled in an aftercooler 5 before being led by a supply line 6 to a pressure regulator 100 and thereafter to an engine 200 or another device.

The compressor comprises a first recycle line 8 which may take compressed gas at the outlet of the first stage 10 and may supply it to the inlet of the first stage 10. A first bypass valve 70 controls the passage of gas through the first recycle line 8. As illustrated on the figures, the gas may be totally or partially or not cooled by an intercooler 72 before being sent in the inlet of the first stage 10. Downstream from the first bypass valve 70, the first recycle line 8 may have two branches, one fitted with the intercooler 72 and a control valve and the other with only a control valve.

In the example shown on FIG. 1, a second recycle line 74 is foreseen. It may take off compressed gas at the outlet of the fourth stage 40, preferably downstream of the aftercooler 5, and may supply it into the first inter-stage line 12, at the inlet of the second stage 20. A second bypass valve 76 controls the passage of gas through the second recycle line 74.

The compressor also comprises a temperature sensor 78, a first pressure sensor 81, a second pressure sensor 82 and a third pressure sensor 83. The temperature sensor 78 measures the temperature of the gas at the inlet of the fourth stage 40 or last stage. This sensor is disposed for example on the third inter-stage line 32, preferably near from the entry of the last stage. It can be also integrated in the entry of the last stage. The first pressure sensor 81 measures the pressure at the inlet of the fourth stage 40, for example at the same point than the temperature sensor 78. The second pressure sensor 82 measures the pressure at the outlet of the fourth stage 40, preferably upstream of the aftercooler 5. The second pressure sensor 82 is for example integrated in the outlet of the last stage. The third pressure sensor 83 measures the pressure after the aftercooler 5 downstream from the junction of the second recycle line 74.

The compressor shown on FIG. 2 is a six stage compressor. Each stage 10, 20, 30, 40, 50 and 60 of this compressor comprises also a centrifugal impeller and these impellers are mechanically connected through a shaft 2 and/or a gearbox. The impellers can be similar but they can also be different, for example with different diameters.

One finds also on FIG. 2 a supply line 4 that feeds gas to the compressor, a first inter-stage line 12, a second inter-stage line 22 and a third inter-stage line 32. Since there are six stages in this compressor, this last also has a fourth inter-stage line 42 which connects the outlet of the fourth stage 40 to the inlet of the fifth stage 50 and finally a fifth inter-stage line 52 between the outlet of the fifth stage 50 of the compressor and the inlet of its sixth stage 60 which is here the last stage.

In this six-stage embodiment, the compressed gas may be cooled for example after the third stage 30 and after the sixth stage 60 in an aftercooler 5, 5'. The aftercooler 5 is mounted in the third inter-stage line 32 and the aftercooler 5' cools the compressed gas before it is led by supply line 6 to an engine 200 or another device through a pressure regulator 100.

The compressor shown on FIG. 2 also comprises a first recycle line 8 with a first bypass valve 70. The gas may also be partially or totally cooled by an intercooler 72 before being sent in the inlet of the first stage 10.

In the example shown on FIG. 2, a second recycle line 74 and a third recycle line 84 are foreseen. The second recycle line 74 may take off compressed gas at the outlet of the third stage 30, preferably downstream of the aftercooler 5, and may supply it into the first inter-stage line 12, at the inlet of the second stage 20. A second bypass valve 76 controls the passage of gas through the second recycle line 74.

The third recycle line 84 may take off compressed gas at the outlet of the sixth stage 60, preferably downstream of the aftercooler 5', and may supply it into the third inter-stage line 32, at the inlet of the fourth stage 40. The third recycle line 84 opens in the third inter-stage line 32 downstream from the derivation from the second recycle line 74. A third bypass valve 86 controls the passage of gas through the third recycle line 84.

The six-stage compressor also comprises a temperature sensor 78, a first pressure sensor 81 and a second pressure sensor 82 and a third pressure sensor 83 which are mounted in a similar way as in the four-stage compressor in regard to the last stage.

In a (four-stage or six-stage) compressor as described here above, or also in other plural stage compressor, the stonewall may be associated to a low head pressure with a high flow through the compressor stages. Operating in the stonewall area leads generally to vibrations and sometimes to damages to the compressor.

A method is now proposed for avoiding these vibrations and/or damages and avoiding the compressor (and more specifically last stage, i.e. fourth stage 40 for FIG. 1 and sixth stage 60 for FIG. 2) working with a low head pressure and a high flow.

According to this method, in a preferred embodiment, an isentropic head coefficient is calculated. It can be done continuously or periodically at a predetermined frequency.

The frequency can be adapted if the temperature and pressure conditions may vary slowly or quickly.

The isentropic head coefficient is given by:

$$\Psi=2*\Delta h/U^2$$

where:

Δh is the isentropic enthalpy rise in the last stage of the compressor,

U is the impeller blade tip speed in the last stage of the compressor.

The isentropic enthalpy rise is given by:

$$\Delta h=R*T\text{in}*\text{In}(P\text{out}/P\text{in})/MW$$

where:

R is the universal gas constant,

Tin is the temperature of the gas at the inlet of the last stage,

Pout is the pressure at the outlet of the last stage,

Pin is the pressure at the inlet of the last stage, and

MW is the molecular weight of the gas going through the compressor.

R value is approximately 8.314 kJ/(kmol K)

Tin is given in K

Pout and Pin are given in bar (a)

MW is given in kg/kmol

Then Δh is given in kJ/kg

The speed of the tip of the blades of the impeller of the last stage is given in m/s.

In a case where the composition of the gas does not vary, or only in a small scale, and where the rotation speed of the shaft 2 is constant:

$$\Psi=\alpha*[T\text{in}*\text{In}(P\text{out}/P\text{in})]$$

It is now proposed to compute Ψ by adapted calculation means 88, which are integrated in the compressor. These calculation means receive information from the temperature sensor 78, from the first pressure sensor 81 and from the second pressure sensor 82. If the molecular weight of the gas can change, information concerning the gas (coming for example from a densitometer and/or a gas analyser) may also be given to the calculation means. In the same way, if the speed of the impeller can change, a tachometer may be foreseen on the shaft 2.

The value of Ψ is then given to electronic control means, for example a compressor load controller 90, which can command associated actuators foreseen in the compressor.

In the proposed method, as an illustrative but not limitative example, it will be considered that the compressor, namely the last stage of the compressor, works next to the stonewall conditions if Ψ is less than 0.2 (with the units given here above).

The engine 200 is for example a dual fuel engine and more particularly a XDF engine. This engine 200 requires a variable pressure at its inlet. The required pressure for the engine 200 is communicated to the compressor load controller 90 and constitutes the set point outlet pressure for the compressor and the compressor load controller 90.

In some cases, the set point outlet pressure is low. In these cases, it can happen that the value of Ψ decreases and becomes smaller than 0.2.

We suppose for example that the required pressure for the inlet of the engine 200 is $P_0$. The compressor load controller 90 regulates the system so that the pressure measured by the third pressure sensor 83 corresponds to $P_0$. For this outlet pressure the value of Ψ is for example 0.25.

Thereafter, the working conditions of the engine 200 varies and the required pressure for the inlet of the engine 200 comes down of $P_1$ (with $P_1<P_0$). The compressor load controller 90 regulates then the pressure in the system. For this regulation, the compressor load controller 90 acts for example on a variable diffusor valve 92 which is associated to a stage of the compressor. On FIGS. 1 and 2, the first stage 10 is fitted with a variable diffusor valve 92. This is a non-limitative example. One other or many other stages can also have a variable diffusor valve. A man having ordinary skill in the art also knows other ways for varying the outlet pressure of a plural stage compressor.

We suppose here that during the regulation of the system, parameters of the compressor system are changed so that value of Ψ becomes equal to or smaller than 0.2.

In order to avoid entering into the stonewall area, it is proposed to change the set point outlet pressure $P_1$ in the compressor load controller 90 by a new set point outlet pressure $P_2$ with ($P_2>P_1$).

By doing this, the pressure at the outlet of the compressor downstream of the aftercooler (5 in FIG. 1, 5' in FIG. 2) will increase to $P_2$ which will correspond to the pressure measured by the third pressure sensor 83. In order to have the good pressure at the inlet of the engine 200, the pressure regulator 100 sets the pressure down to $P_1$ which is the pressure required by the engine 200. This required pressure can be communicated to the pressure regulator 100 either by the compressor load controller 90 (FIG. 1) or directly by the engine 200 (FIG. 2). Many pressure regulation systems exist and work for making the requested pressure regulation.

The regulation made by the compressor load controller 90 is for example programed so that the value of Ψ stays equal to 0.2. Later, if the pressure required by the engine 200 increases, the compressor load controller 90 will change its set point outlet pressure and the value of Ψ can again be greater than 0.2.

This method of regulation is based on the fact that the limitation concerning stonewall in the plural stage compressor in the given situation comes from the last stage.

Although in a preferred embodiment of the proposed method, an insentropic head coefficient is calculated, a method based on the calculation of another coefficient depending from the inlet temperature and from the ratio of the outlet pressure by the inlet pressure may also works. Preferably, the coefficient depends from $$T\text{in}*\text{In}(P\text{out}/P\text{in}).$$

An advantage of the proposed method is that it can work without changing a prior art compressor. The pressure regulator can be for example the gas valve unit (GVU) which is usually mounted upstream an engine in order to regulate the inlet pressure of the engine.

The above description concerns plural stage compressors. However, the method described here above can also work with an one-stage compressor.

A compressor as described here above may be used on a boat, or on a floating storage regasification unit. It can also be used onshore, for example in a terminal, or also on a vehicle for example a train. The compressor may supply an engine or a generator (or another working device).

Obviously, one should understand that the above detailed description is provided only as embodiment examples of the invention. However secondary embodiment aspects may be adapted depending on the application, while maintaining at least some of the advantages cited.

The invention claimed is:

1. Method for controlling a compressor comprising at least a last stage (40; 60) and a compressor load controller (90), a first set point outlet pressure, corresponding to a consumer needed pressure, being given in the compressor load controller (90), characterised in that it comprises the steps of:

a—measuring the temperature at the inlet of the last stage (40; 60), b—measuring the ratio between the outlet pressure (Pout) and the inlet pressure (Pin) of the last stage (40; 60) of the compressor, c—computing a coefficient (Ψ) based at least on the value of the inlet temperature (Tin) and on the measured pressure ratio (Pout/Pin), d—if the computed coefficient (Ψ) is in a predetermined range, changing the first set point outlet pressure by a second set point outlet pressure greater than the first set point outlet pressure until the coefficient (Ψ) computed with the second set point outlet pressure goes out of the predetermined range, and e—adapting the pressure of the fluid coming out of the compressor in a pressure regulator (100) to the first set point outlet pressure corresponding to the consumer needed pressure.

2. Method according to claim 1, characterised in that the coefficient (Ψ) computed in step c is a coefficient calculated by multiplying the inlet temperature (Tin) of the compressor by a logarithm of the ratio of the outlet pressure by the inlet pressure (Pout/Pin).

3. Method according to claim 2, characterised in that the coefficient calculated in step c is a head coefficient:

$$\Psi=2*\Delta h/U^2$$

where:

Δh is the isentropic enthalpy rise in the last stage,

U is the impeller blade tip speed, and in that $$\Delta h=R*T\text{in}*\text{In}(P\text{out}/P\text{in})/MW$$

where:

R is a constant,

Tin is the temperature of the gas at the inlet of the last stage (40; 60), Pout is the pressure at the outlet of the last stage (40; 60), Pin is the pressure at the inlet of the last stage (40; 60), and MW is the molecular weight of the gas going through the compressor.

4. Method according to claim 1, characterised in that in step d, if the computed coefficient (Ψ) is less than a predetermined value, the second set point outlet pressure is so that the coefficient (Ψ) computed with this second set point outlet pressure equals the predetermined value.

5. Method according to claim 1, characterised in that the compressor is a plural stage compressor, in that at least one stage (10) of the compressor comprises a variable diffusor valve (92) and in that the compressor load controller (90) adjusts the discharge pressure of the compressor by acting on at least one variable diffusor valve (92).

6. Gas supplying system with a compressor comprising:

at least one compressor stage, so called last stage (40; 60), a compressor load controller (90), a temperature sensor (78) for measuring the temperature (Tin) at the inlet of the last stage (10), a first pressure sensor (81) for measuring the pressure (Pin) at the inlet of the last stage (40; 60), characterised in that the system further comprises:

a pressure regulator (100) downstream from the last stage, and means (88, 90) for implementing a method according to claim 1.

7. Gas supplying system according to claim 6, characterised in that at least a compressor stage (10) comprises a variable diffusor valve (92).

8. Gas supplying system according to claim 6, characterised in that the compressor is a plural stage centrifugal compressor.

9. Gas supplying system according to claim 8, characterised in that the compressor is a four stage compressor.

10. Gas supplying system according to claim 8, characterised in that the compressor is a six stage compressor.

11. Gas supplying system according to claim 8, characterised in that each stage comprises an impeller.

12. Gas supplying system according to claim 11, characterised in that all said impellers are mechanically connected.

* * * * *